US008191649B2

(12) United States Patent
Zhu

(10) Patent No.: US 8,191,649 B2
(45) Date of Patent: Jun. 5, 2012

(54) IMPACT SCREWDRIVER HAVING A SHAFT LOCKING DEVICE

(75) Inventor: Yongbing Zhu, Nanjing (CN)

(73) Assignee: Chervon Limited, Wanchai (HK)

( * ) Notice: Subject to any disclaimer, the term of this patent is extended or adjusted under 35 U.S.C. 154(b) by 319 days.

(21) Appl. No.: 12/592,361

(22) Filed: Nov. 24, 2009

(65) Prior Publication Data

US 2010/0126745 A1 May 27, 2010

(30) Foreign Application Priority Data

Nov. 25, 2008 (CN) ..... 2008 2 0215227 U

(51) Int. Cl.
*B25B 19/00* (2006.01)
*B25B 21/02* (2006.01)

(52) U.S. Cl. ..... 173/47; 173/93; 173/93.5; 173/109; 173/114; 173/48; 173/93.6; 173/104

(58) Field of Classification Search ..... 173/93–93.6, 173/104, 109, 114, 47–48
See application file for complete search history.

(56) References Cited

U.S. PATENT DOCUMENTS

| | | | | |
|---|---|---|---|---|
| 3,001,428 | A * | 9/1961 | Sindelar | 173/93.6 |
| 3,053,360 | A * | 9/1962 | Madsen | 173/93.6 |
| 6,457,535 | B1 * | 10/2002 | Tanaka | 173/48 |
| 2007/0034398 | A1 * | 2/2007 | Murakami et al. | 173/210 |
| 2007/0267207 | A1 * | 11/2007 | Ito | 173/217 |

* cited by examiner

*Primary Examiner* — Paul R. Durand
*Assistant Examiner* — Michelle Lopez
(74) *Attorney, Agent, or Firm* — McDermott Will & Emery LLP

(57) ABSTRACT

The present invention provides both an impact switching function and a shaft locking function for use in an impact screwdriver. The impact screwdriver includes a housing, a motor located in the housing, a motor drive shaft driven by the motor, a hammer which can move axially and rotate around the motor drive shaft, a hammer anvil, an impact switching device and a shaft locking apparatus. The shaft locking apparatus has a mating member coupled with the hammer anvil, an engagement ring fixed to the housing and a middle member located between the mating member and the engagement ring. The shaft locking apparatus has a locked position, where the mating member is secured to the hammer anvil and also secured to the engagement ring and the housing.

18 Claims, 7 Drawing Sheets

IMPACT SCREWDRIVER HAVING A SHAFT LOCKING DEVICE

CROSS-REFERENCE TO RELATED APPLICATIONS

This application claims priority under 35 U.S.C. §119 to CN 200820215227.8 filed Nov. 25, 2008, and is hereby incorporated by reference.

FEDERALLY SPONSORED RESEARCH OR DEVELOPMENT

Not Applicable.

TECHNICAL FIELD

The present invention relates to an impact screwdriver, and more particularly, to an impact screwdriver having a shaft locking device.

BACKGROUND OF THE INVENTION

Generally, a shaft locking device is used in power tools like drills and screwdrivers. A shaft locking device allows a user to manually tighten the screws by turning a housing of the power tool after the screws are initially secured using a motor shaft. Further, when the battery is fully discharged, the shaft locking device allows the power tool to still be used to tighten or loosen screws manually by turning the housing of the power tool. In other words, the shaft locking device prevents the output shaft from turning separate from the screwdriver housing.

Other screwdrivers also have an additional circumferential direction impact function. For example, the output shaft driven by the motor may provide an additional circumferential contact position while tightening a screw which increases the effectiveness of the screwdriver.

SUMMARY OF THE INVENTION

The present invention provides a shaft locking device for an impact screwdriver, which allows the combination of an impact switching function and a shaft locking function.

The impact screwdriver includes a housing, a motor located in the housing, a motor drive shaft, a hammer which can move axially and rotate around the motor drive shaft driven by the motor, a hammer anvil which is hit by the hammer, an impact switching device, and a shaft locking apparatus. The shaft locking device has a mating member coupled with the hammer anvil, an engagement ring fixed on the housing, and a middle member located between the mating member and the engagement ring. Also, a raised part is located on the outer portion of the hammer, and the hammer anvil is close to the hammer to allow the striking portion of the hammer anvil to receive a strike from the raised part of the hammer.

The striking portion is fixed on the hammer anvil in both a circumferential direction and an axial direction. The outer surface of the mating member has a recessed surface. The mating member is set on the hammer anvil and is rotatable with it. Further, an additional engagement member is included in the shaft locking device.

The engagement member has a first position and a second position. When the engagement member is in the first position, the engagement member is secured between the end of recessed surface of the mating member and the engagement ring. Also, the mating member is fixed to the engagement ring in a circumferential direction, resulting in the shaft locking device being in a locked position.

When the engagement member is in the second or unlocked position, the engagement member is no longer secured between the recessed surface of the mating member and engagement ring. As a result, the mating member may be rotated relative to the engagement ring, allowing both the hammer anvil and a paddle, having an inner hexagonal hole, to travel on the same axis.

The impact switching apparatus includes a lever, a hexagonal piece and an inner hexagonal opening located on the hammer anvil. The impact switching device is engaged in the impact position when the hexagonal piece is located within the hexagonal opening of the hammer anvil. The impact switching device is in an off or disengaged position when the hexagonal piece is pulled out of the hexagonal opening of hammer anvil.

The hammer also has a raised part located on the outer surface. The end of the hammer anvil closest to the hammer has a striking portion to receive a strike from the hammer. The striking portion is fixed to the hammer anvil both axially and circumferentially.

The recessed surfaces located on the outer surface of the mating member have a radius that is smaller than the radius of the remainder of the outer surface of the mating member. The mating member also has a pair of bayonets symmetrically distributed on the outer surface, such that when mating member is placed on the end of the hammer anvil closest to the striking portion, the striking portion is received within the bayonets and the angle of rotation of the mating member relative to the hammer anvil is limited to 5 degrees or less.

The middle member also includes a pair of receiving openings which are located symmetrically on its outer surface. The elements in contact with the engagement members or cylindrical pin include the receiving openings, the recessed surfaces of the mating member, the engagement ring and a pair of engagement lugs, where the engagement lugs are hit by the raised part of the hammer when the impact screwdriver is engaged. The engagement ring also has a pair of mounting holes to fasten the engagement ring to the screwdriver and housing.

BRIEF DESCRIPTION OF THE DRAWINGS

Additional advantages and features of the present invention will become apparent from the subsequent description and the appended claims, taken in conjunction with the accompany drawings, wherein:

DETAILED DESCRIPTION

Figure 1:
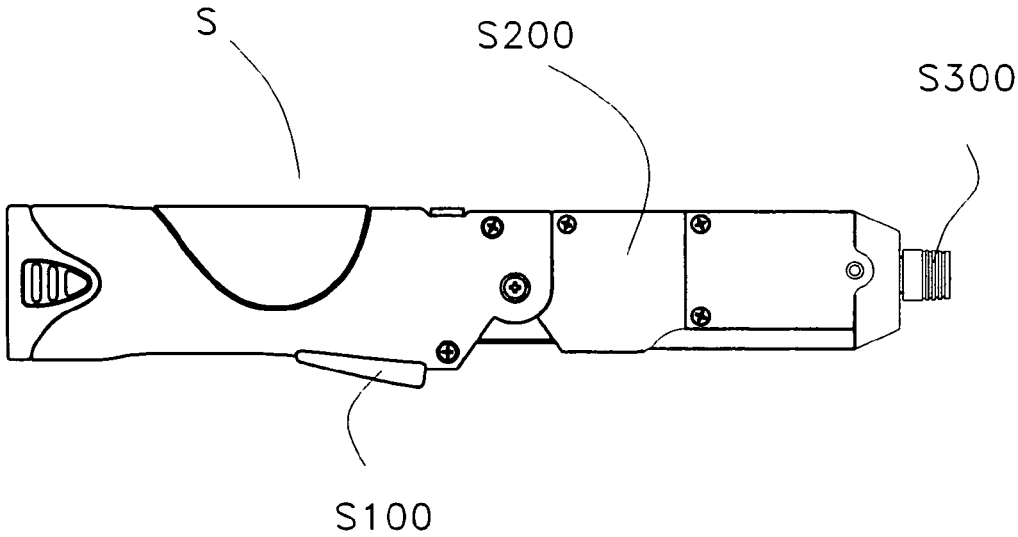
FIG. 1 is a perspective view of a screwdriver constructed in accordance with the teachings of the present invention.

Referring to FIG. 1, a screwdriver S constructed in accordance with the teachings of the present invention is comprised of a switch S100, a housing S200 and a bit S300 mounted on the front end of the housing S200.

Figure 2A:
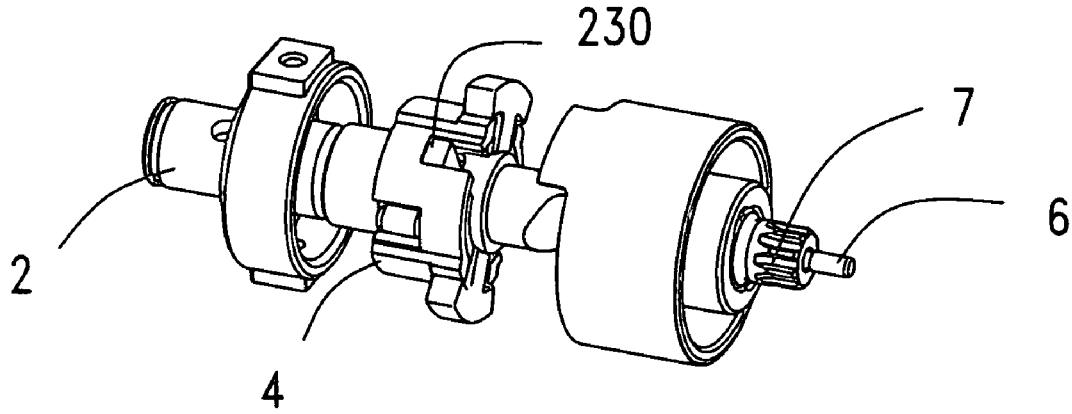
FIG. 2*a* is a perspective view of the inner structure of the screwdriver.
Figure 2B:
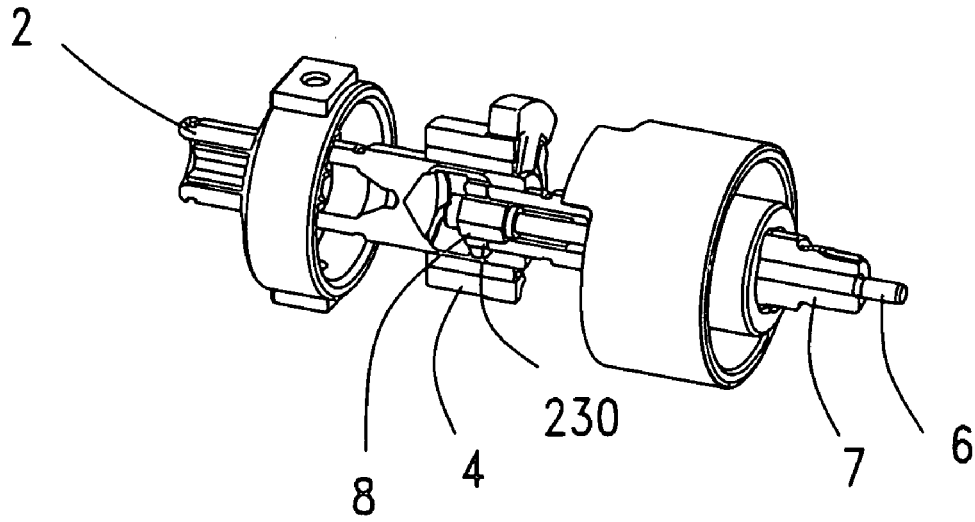
FIG. 2*b* is a sectional view of the inner structure of the screwdriver.
Figure 2C:
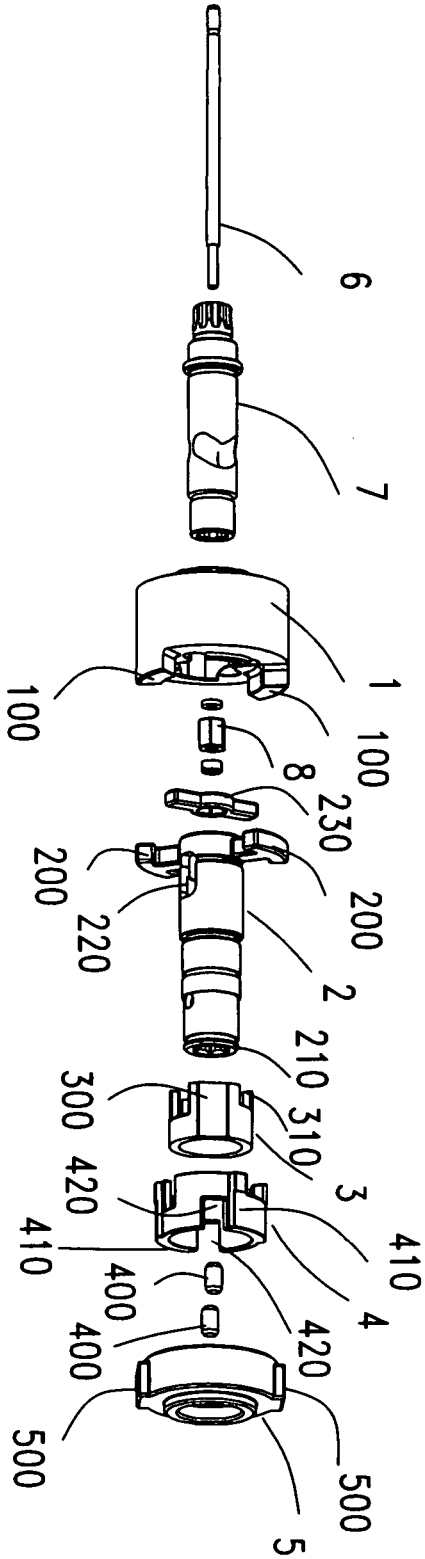
FIG. 2*c* is an exploded view of the inner structure of the screwdriver.

As shown in FIGS. 2*a*-2*c*, the impact device of the screwdriver S comprises a hammer 1, a hammer anvil 2, and an impact switch device. The hammer anvil 2 has a hexagonal opening 220. The impact switch device includes a lever 6 and a hexagonal piece 8. The lever 6 controls the movement of the hexagonal piece 8 in and out of the inner hexagonal opening 220 of the hammer anvil 2. As a result, the lever 6 also controls the ability of the main shaft 7 to rotate with respect to the hammer anvil 2 through use of the impact switch device. When the hexagonal piece 8 is not lined up with the inner hexagonal opening 220 of the hammer anvil 2, the impact function of the screwdriver is enabled and the hammer 1 is able to move axially.

A pair of raised portions 100 are disposed on an edge of the outer portion of the hammer 1. And a pair of striking portions 200 are mounted symmetrically on the end of hammer anvil 2 closest to the hammer 1. The pair of striking portions 200 are at an angle of 180 degrees relative to each other and are part of the hammer anvil 2. Further, the pair of striking portions 200 are not able to have any displacement in either a circumferential direction or an axial direction relative to hammer anvil 2. The striking portions 200 of the hammer anvil 2 are hit by the raised portions 100 of the hammer 1 when the hammer 1 moves axially. The end of the hammer anvil 2, opposite the hammer 1, is a tool setting end 210.

The shaft locking device of the impact screwdriver S comprises a mating member 3, a middle member 4 and an engagement ring 5. A paddle 230 with an inner hexagonal opening is mounted next to the hammer anvil 2, and the paddle 230 is fixed in the middle member 4.

The mating member 3 includes a pair of bayonets 310 on its outer edge. (Only a single bayonet is shown in FIG. 2*c*). The outer edge of the mating member 3 also has a pair of symmetrically recessed surfaces 300 (only one of the recessed surfaces 300 is shown in FIG. 2*c*), which are discussed in more detail below.

The middle member 4 includes a pair of receiving openings 420 on its outer edge for receiving a pair of engagement members 400, which are a pair of cylindrical pins. The middle member 4 also has a pair of engagement lugs 410 symmetrically mounted on its outer surface.

The engagement ring 5 has a pair of mounting holes 500 symmetrically mounted on its outer circumference to allow for fastening to the housing S200. The screw threads in the mounting holes 500 in combination with screws secure it to the head of housing S200 and do not allow the engagement ring 5 to rotate separate from the housing S200.

The elements in contact with the engagement members 400 include the receiving openings 420 of the middle member 4, the recessed surfaces 300 of the mating member 3 and the engagement ring 5. To assemble the shaft locking device, the mating member 3 is placed over the hammer anvil 2, and the snap bayonets 310 are connected with the striking portion 200. The width of the bayonets 310 is such that when mating member 3 is placed on the end of the hammer anvil 2 closest to the striking portion 200, the striking portion 200 is received within the bayonets 310 and the angle of rotation of the mating member 3 relative to the hammer anvil 2 is limited to 5 degrees or less. After the mating member 3 is placed over the hammer anvil 2, the middle member 4 is placed on the mating member 3 and the pair of engagement members 400 are placed in the receiving openings 420. Finally, the engagement ring 5 is placed on the middle member 4.

Figure 3:
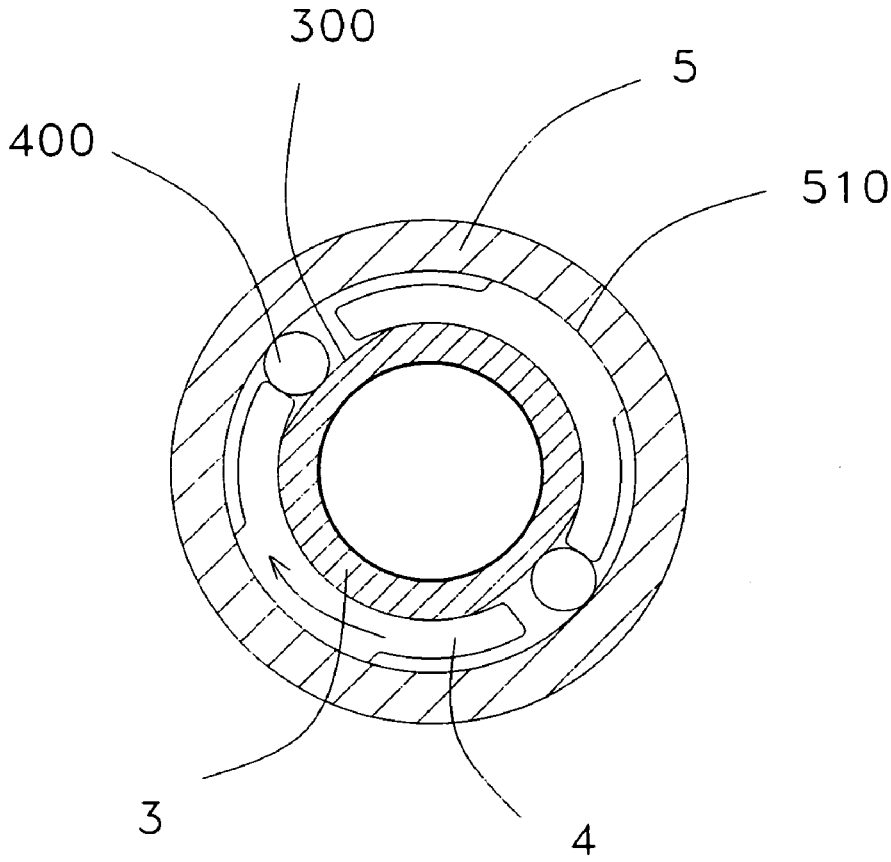
FIG. 3 is an enlarged view of the shaft locking device of the screwdriver in the locked position.
Figure 5:
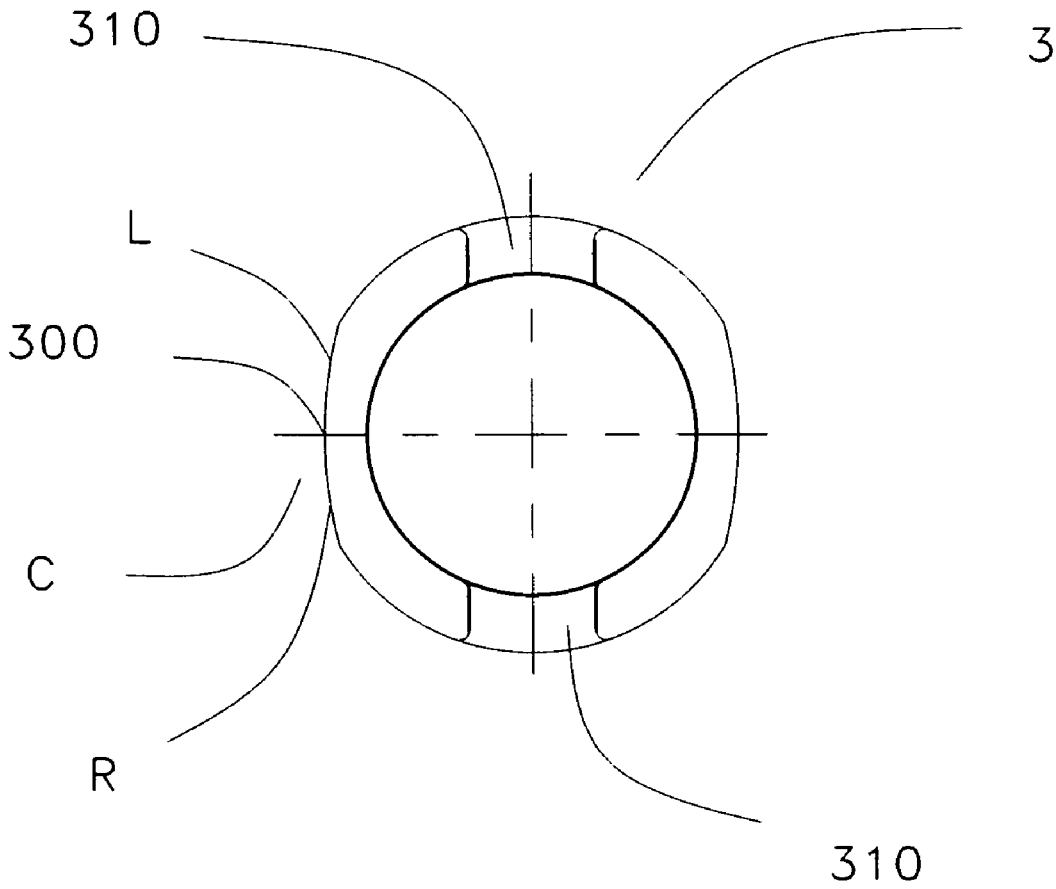
FIG. 5 is an enlarged view of the mating member of the shaft locking device.

As shown in FIGS. 3 and 5, the radius of the recessed surface 300 is smaller than the radius of the remainder of the mating member 3. The recessed surface 300 is divided into three areas, when the engagement members 400 are located in area C, the diameter of engagement members 400 allow the mating member 3 to move. When the engagement members 400 are rotated into areas L or R, the engagement members 400 are secured between recessed surface 300 and the inner circumference 510 of the engagement ring 5 because the radii of areas L and R are larger than the radius of area C. As a result, the engagement member 400 is placed in a locked position.

Figure 4:
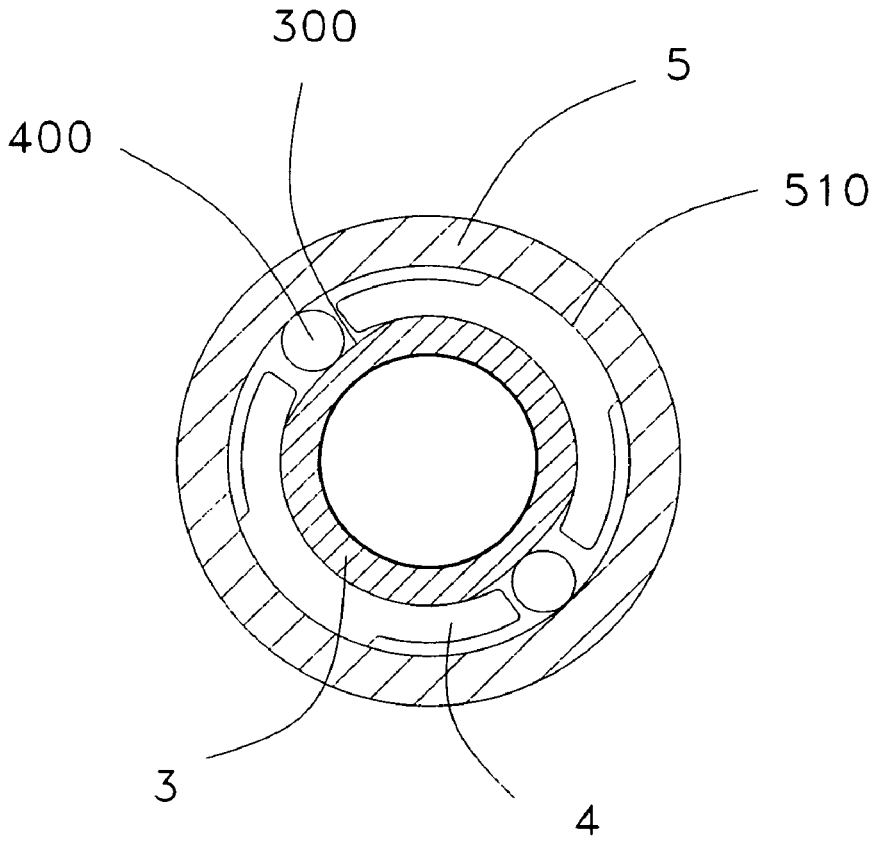
FIG. 4 is an enlarged view of the shaft locking device of the screwdriver in the unlocked position.

With reference to FIGS. 3 and 4, the shaft locking device will now be described in further detail. As shown in FIG. 3, when the housing S200 of screwdriver S is manually driven by a user, the tool setting end 210 of hammer anvil 2 rotates because of reaction torque of the bolt being tightened or loosed. The hammer anvil 2 rotates in a clockwise direction, and because the mating member 3 can only rotate an angle smaller than 5 degrees relative to hammer anvil 2, the hammer anvil 2 will cause the mating member 3 to rotate as well after a small rotation in a clockwise direction. Also, the hammer anvil 2 rotates together with mating member 3. The rotation of the mating member 3 in a clockwise direction causes one of the engagement pins 400 to rotate into a recessed surface 300 and enter the area R while the other engagement pin 400 enters area L of another recessed surface 300. As a result, both of the engagement pins 400 are in the lock condition and mating member 3 is unable to rotate relative to engagement ring 5, which also means that the hammer anvil 2 is not able to rotate relative to housing S200, and the shaft locking device is in the full lock position.

As shown in FIG. 4, when the housing S200 of screwdriver S is manually driven by a user in a negative direction, the main shaft 7 rotates along with the middle member 4 and mating member 3. Because of the paddle 230 being fixed to the middle member 4, and being located in the hammer anvil 2, the device can be unlocked by pushing the hammer anvil 2 using the middle member 4. The engagement pins 400 enter area C of the recessed surfaces 300 through the rotation of the mating member 3 in a counter-clockwise direction. As a result, the engagement pins 400 become movable and the shaft locking device is placed in the unlocked position.

If the housing S200 continues to be driven by a user in a negative direction, the engagement pins 400 re-enter a locking position, and the shaft locking device is returned to a full lock position. Without the paddle 230 in the hammer anvil 2, the main shaft 7 may rotate without rotating the middle member 4 and the mating member 3 and will only cause the hammer anvil 2 to rotate when the screwdriver is in the non-impact status caused by the hexagonal piece 8 being moved into the inner hexagonal opening 220 of hammer anvil 2. Placing the hexagonal piece 8 into the inner hexagonal opening 220 of hammer anvil 2 will also prevent the device from being unlocked, and will prevent the hammer anvil 2 from rotating which prevents the screwdriver from working.

What is claimed is:

1. An impact screwdriver, the screwdriver comprising:

a housing;

a motor located in the housing;

a motor drive shaft driven by the motor;

a hammer which can move axially and rotate around the motor drive shaft;

a hammer anvil;

an impact switching apparatus; and, a shaft locking device, said shaft locking device having a mating member coupled with the hammer anvil, an engagement ring fixed to the housing, and a middle member located between the mating member and said engagement ring, wherein the orientation of the hammer anvil defines a first axis and a paddle is positioned on the first axis and is fixed to the middle member and wherein the mating member further has a pair of bayonets on the outer edge.

2. The impact screwdriver of claim 1, wherein the shaft locking device further comprises:

an engagement member;

a raised part located on the outer portion of the hammer; and, the hammer anvil having a striking portion on an end nearest the hammer to contact the raised part of the hammer, said striking portion being fixed to the hammer anvil.

3. The impact screwdriver of claim 2, wherein the engagement member has a first position and a second position, wherein when the engagement member is in the first position, the engagement member is secured between a recessed surface of the mating member and the engagement ring, and the mating member is thereby fixed to the engagement ring causing the shaft locking device to be in a locked position; and, wherein when the engagement member is in the second position, the engagement member is not secured between the recessed surface of the mating member and the engagement ring and the mating member is rotatable relative to the engagement ring resulting in the shaft locking device to be placed in an unlocked position.

4. The impact screwdriver of claim 2, wherein the middle member includes a pair of receiving openings, and the engagement member is in contact with the middle member, the recessed surface of the mating member, the engagement ring, a pair of engagement lugs, said engagement lugs being contacted by the raised part of the hammer when the impact screwdriver is in working condition.

5. The impact screwdriver of claim 2, wherein the engagement member is a cylindrical pin.

6. The impact screwdriver of claim 1, wherein the mating member has a recessed outer surface, the mating member further being in contact with the hammer anvil and being rotatable with the hammer anvil.

7. The impact screwdriver of claim 6, wherein a radius of the recessed outer surface of the mating member is smaller than a radius of the remainder of the outer edge of the mating member.

8. The impact screwdriver of claim 1, wherein the impact switching device comprises a lever, a hexagonal piece, an inner hexagonal opening located on the hammer anvil, the impact switching device being in an impact position when the hexagonal piece is positioned within the hexagonal opening of hammer anvil, and the impact switching device being in a non-impact position when the hexagonal piece is not positioned within the hexagonal opening of the hammer anvil.

9. The impact screwdriver of claim 1, wherein the paddle has an inner hexagonal hole.

10. The impact screwdriver of claim 1, wherein when the mating member is located on the end of the hammer anvil closest to the striking portion, the striking portion is received within the bayonets and the angle of rotation of the mating member relative to the hammer anvil is limited to 5 degrees or less.

11. The impact screwdriver of claim 1, wherein a pair of mounting holes on the outer surface of the engagement ring are used to engage the engagement ring to the screwdriver.

12. An impact screwdriver, the screwdriver comprising:

a housing;

a motor located in the housing;

a motor drive shaft driven by the motor;

a hammer which can move axially and rotate around the motor drive shaft;

a hammer anvil;

an impact switching apparatus;

a shaft locking device, said shaft locking device having a mating member coupled with the hammer anvil, an engagement ring fixed to the housing, and a middle member located between the mating member and said engagement ring, wherein the orientation of the hammer anvil defines a first axis and a paddle is positioned on the first axis and is fixed to the middle member;

the shaft locking device further including an engagement member;

a raised part located on the outer portion of the hammer, the hammer anvil having a striking portion on an end nearest the hammer to contact the raised part of the hammer, said striking portion being fixed to the hammer anvil, the mating member having a recessed outer surface, the mating member further being in contact with the hammer anvil and being rotatable with the hammer anvil, the engagement member having a first position and a second position, wherein when the engagement member is in the first position, the engagement member is secured between the recessed surface of the mating member and the engagement ring, and the mating member is thereby fixed to the engagement ring causing the shaft locking device to be in a locked position;

wherein when the engagement member is in the second position, the engagement member is not secured between the recessed surface of the mating member and the engagement ring and the mating member is rotatable relative to the engagement ring resulting in the shaft locking device to be placed in an unlocked position; and, further wherein the mating member further has a pair of bayonets on the outer edge and wherein when the mating member is located on the end of the hammer anvil closest to the striking portion, the striking portion is received within the bayonets and the angle of rotation of the mating member relative to the hammer anvil is limited to 5 degrees or less.

13. The impact screwdriver of claim 12, wherein the impact switching device comprises a lever, a hexagonal piece, an inner hexagonal opening located on the hammer anvil, the impact switching device being in an impact position when the hexagonal piece is positioned within the hexagonal opening of the hammer anvil, and the impact switching device being in a non-impact position when the hexagonal piece is not positioned within the hexagonal opening of the hammer anvil.

14. The impact screwdriver of claim 12, wherein the paddle has an inner hexagonal hole.

15. The impact screwdriver of claim 12, wherein a radius of the recessed outer surface of the mating member is smaller than a radius of the remainder of the outer edge of the mating member.

16. The impact screwdriver of claim 12, wherein the middle member includes a pair of receiving openings, and the engagement member is in contact with the middle member, the recessed surface of the mating member, the engagement ring, a pair of engagement lugs, said engagement lugs being contacted by the raised part of the hammer when the impact screwdriver is in working condition.

17. The impact screwdriver of claim 12, wherein a pair of mounting holes on the outer surface of the engagement ring are used to engage the engagement ring to the screwdriver.

18. The impact screwdriver of claim 12, wherein the engagement member is a cylindrical pin.

* * * * *